US005581335A

United States Patent [19]

Borton et al.

[11] Patent Number: 5,581,335

[45] Date of Patent: Dec. 3, 1996

[54] PROGRAMMABLE TONER CONCENTRATION AND TEMPERATURE SENSOR INTERFACE METHOD AND APPARATUS

[75] Inventors: Michael D. Borton, Ontario; Kevin M. Carolan, Webster, both of N.Y.

[73] Assignee: Xerox Corporation, Stamford, Conn.

[21] Appl. No.: 334,493

[22] Filed: Nov. 4, 1994

[51] Int. Cl.[6] ..... G03G 21/00

[52] U.S. Cl. ..... 355/246; 118/688; 118/689; 355/204

[58] Field of Search ..... 355/203, 204, 355/208, 246; 118/688, 689, 691, 694

[56] References Cited

U.S. PATENT DOCUMENTS

| | | | |
|---|---|---|---|
| 3,604,939 | 5/1968 | Maksymisk | 250/218 |
| 4,144,550 | 3/1979 | Donohue et al. | 364/107 |
| 4,314,334 | 2/1982 | Daughton et al. | 364/200 |
| 4,326,646 | 4/1982 | Lavery et al. | 222/56 |
| 4,419,010 | 12/1983 | Grombone et al. | 355/133 |
| 4,478,509 | 10/1984 | Daughton et al. | 328/1 |
| 4,706,032 | 11/1987 | Allen et al. | 118/689 X |
| 4,734,737 | 3/1988 | Koichi | 355/206 |
| 4,829,336 | 5/1989 | Champion et al. | 355/246 |
| 4,901,115 | 2/1990 | Nakamura et al. | 355/246 |
| 4,931,835 | 6/1990 | Higgins et al. | 355/203 |
| 4,962,407 | 10/1990 | Ueda | 355/208 |
| 4,974,025 | 11/1990 | Kikuchi | 355/246 |
| 4,980,727 | 12/1990 | Stelter | 355/246 |
| 5,012,286 | 4/1991 | Kawano et al. | 355/246 |
| 5,053,822 | 10/1991 | Butler | 355/246 |
| 5,067,435 | 11/1991 | Hosaka | 118/653 |
| 5,081,491 | 1/1992 | Lux et al. | 355/208 |
| 5,081,498 | 1/1992 | Bares | 355/246 |
| 5,111,247 | 5/1992 | Nichols | 355/246 |
| 5,166,729 | 11/1992 | Rathbun et al. | 355/208 |
| 5,189,475 | 2/1993 | Fournia et al. | 355/246 |
| 5,214,476 | 5/1993 | Nomura et al. | 355/246 |
| 5,311,261 | 5/1994 | Nakagama et al. | 355/246 |
| 5,353,103 | 10/1994 | Okamoto et al. | 355/246 |

*Primary Examiner*—William J. Royer

*Attorney, Agent, or Firm*—Fay, Sharpe, Beall, Fagan, Minnich & McKee

[57] ABSTRACT

In accordance with the present invention a toner concentration and temperature sensing apparatus is provided for use with a developer container adapted to retain a quantity of developer material, the developer material including varying concentrations of magnetic carrier material and toner material. The toner sensing apparatus includes a micro controller device for controlling a sensing head to selectively generate a magnetic field within the developer container according to a first set of parameters stored in the micro controller. A preselected portion of the developer material is compressed by the magnetic field and a signal is generated across the sensing device and determining the resistance thereof. The signal across the sensing device varies as a function of the concentration of the toner. The micro controller converts the observed signal into a toner concentration value based on a second set of stored parameters. The developer temperature is obtained by measuring a voltage across a coil comprising the sensing device. The change in coil resistance is a linear function of developer temperature.

21 Claims, 10 Drawing Sheets

PROGRAMMABLE TONER CONCENTRATION AND TEMPERATURE SENSOR INTERFACE METHOD AND APPARATUS

BACKGROUND OF THE INVENTION

1. Field of the Invention

The present invention relates generally to an apparatus for sensing toner concentration in a container of developer material, and more particularly, to a technique employing a programmable active magnetic force to compress a preselected volume of developer material so that a representative permeability measurement of the developer material in the container can be obtained. The temperature of the developer material is also sensed using the device developing the magnetic force.

2. Description of the Prior Art

In an electrophotographic printing machine, the photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing marking or toner particles into contact therewith. This forms a powder image on the photoconductive member which is subsequently transferred to a copy sheet. The copy sheet is heated to permanently affix the marking particles thereto in image configuration.

Various types of development systems have herein before been employed. These systems utilize two (2) component developer mixes or single component developer materials. Typical two component developer mixes employed are well known in the art, and generally comprise dyed or colored thermoplastic powders, known in the art as toner particles, which are mixed with coarser carrier granules, such as ferromagnetic granules. The toner particles and carrier granules are selected such that the toner particles acquire the appropriate charge relative to the electrostatic latent image recorded on the photoconductive surface. When the developer mix is brought into contact with the charged photoconductive surface, the greater attractive force of the electrostatic latent image recorded thereon causes the toner particles to transfer from the carrier granules and adhere to the electrostatic latent image.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner particles of a color complimentary thereto. This process is repeated a plurality of cycles for differently colored images and their respective complimentary colored toner particles. For example, a red filtered light image is developed with cyan toner particles, while a green filtered light image is developed with magenta toner particles and a blue filtered light image with yellow toner particles. Each single color toner powder image is transferred to the copy sheet superimposed over the prior toner powder image. This creates a multi-layered toner powder image on the copy sheet. Thereafter, the multi-layered toner powder image is permanently affixed to the copy sheet creating a color copy. An illustrative electrophotographic printing machine for producing color copies is the Model No. 1005 made by the Xerox Corporation.

It is evident that in printing machines of this type, toner particles are depleted from the developer mixture. As the concentration of toner particles decreases, the density of the resultant copy degrades. In order to maintain the copies being reproduced at a specified minimum density, it is necessary to regulate the concentration of toner particles in the developer mixture. Moreover, sensing of toner concentration provides valuable input for process control at the development station as well as other stations of the electrophotographic printing machine. Toner concentration can be regulated by various known techniques, one of which includes monitoring an electro-magnetic property of the developer, such as permeability, permitivity or conductivity, to obtain information regarding the carrier-toner ratio.

A number of attempts have been made in the past to sense and control toner concentration in the developer mixture using "passive" magnetic sensors. This type of sensor is capable of determining toner concentration by measuring the magnetic permeability of developer flowing through a tube or the like. U.S. Pat. No. 3,572,551 discloses an apparatus for monitoring and controlling the concentration of toner in a developer mix. U.S. Pat. No. 3,698,926 discloses a method and apparatus for supplementing toner in electrophotographic machines. U.S. Pat. No. 3,802,381 discloses an apparatus for measuring the ratio of ferromagnetic carrier particles to toner particles in an electrostatic printing machine. U.S. Pat. No. 3,970,036 discloses a toner concentration detector in which developer removed from a photoreceptive member after developing is directed through a duct. Lastly, Xerox Disclosure Journal, Vol. 5, No. 3 at page 315 discloses a toner concentration meter system comprising a tube located in the air core of a transformer.

It has been found that in the above-cited references the passive sensors have a sensitivity to developer flow variations, and accordingly are subject to undesirable levels of "noise" or error. Other problems, such as developer aging, non-geometric packing fractions and changes in the environment also have an adverse effect on the performance of such passive sensors. U.S. Pat. No. 3,707,134 proposes an alternative to the passive sensors whereby an apparatus is provided for monitoring and controlling the ratio of toner-to-carrier particles of a developer mix. The apparatus includes an inductive sensing coil having an iron core. The coil is placed in the surroundings of the developer apparatus of an electrostatic copying machine so as to be in contact relation with the developer mix containing toner and magnetizable carrier particles. The inductive reactance of the coil is a function of the ratio of magnetizable particles per toner particles in the mix. Thus, as the toner is depleted, the inductance of the coil changes. The frequency of an oscillator circuit connected to the coil changes as the inductance of the coil is varied. The change in frequency produces a corresponding output to additional circuity which in turn operates a toner dispenser unit, causing toner to be added to the mix to restore the toner-to-carrier ratio to a predetermined level.

While the sensing arrangement of U.S. Pat. No. 3,707,134 identified above avoids some of the above-mentioned problems in connection with the passive sensors, it is relatively complex in design, and can yield inaccurate results. In particular, the sensor of this arrangement is positioned adjacent a magnetic brush and can thus become contaminated by stray developer material. Moreover, unless the layer of developer on the brush is closely metered, inaccurate toner concentration readings can be expected. Finally, the circuitry for the arrangement identified in that patent includes many components, and is thus relatively expensive to manufacture.

Another "active" magnetic sensor has been proposed in U.S. Pat. No. 5,166,729. This sensor is for use with a developer container adapted to retain a quantity of developer material therein, the developer material including varying concentrations of a magnetic carrier material and toner material. The toner concentration sensing apparatus comprises a device for generating a magnetic field within the developer container. The apparatus further comprises a device for controlling the generating device to selectively generate the magnetic field within the developer container, whereat a preselected portion of the developer material is compressed or otherwise compacted by the magnetic field. A signal is then generated across the generating device. The signal varies as a function of the concentration of the toner material.

While the above-identified prior sensing apparatus represents a significant improvement over the "passive" magnetic sensors, it would be useful to provide a flexible and programmable interface between the sensors and the main control system of the electrophotographic printing machine. For color machines, a single flexible interface would connect the plurality of individual sensors to the printing machine main control system.

It would further be desirable to provide a sensing apparatus that is capable of measuring magnetic permeability of developer material without being subjected to undesirable levels of noise arising in analog signal lines to the main control. Moreover, it would be desirable to provide a relatively inexpensive yet flexible sensing apparatus that is both easy to implement and programmable on-the-fly, using software parameters downloaded from a host in order to adapt to various operating conditions and environmental changes which may affect the operation of the electrophotographic printing machine. Such an apparatus including downloaded software parameters would simplify retrofitting procedures.

It would also be desirable to provide the above sensing apparatus with the further capability to sense the temperature of the toner or developer material with little or no additional hardware overhead.

SUMMARY OF THE INVENTION

In accordance with the present invention, a toner concentration and developer temperature sensing method and apparatus is provided for use with a developer container adapted to retain a quantity of developer material, the developer material including varying concentrations of magnetic carrier material and toner material. The toner concentration sensing apparatus comprises programmable field generating means for generating a magnetic field within the developer container. The apparatus further comprises means for controlling the generating means to selectively generate the magnetic field within the developer container wherein a preselected portion of the developer material is compressed using a selectable magnetic field intensity. A signal is then generated across the generating means after the material is compacted. The generated signal varies as a function of the concentration of the toner material.

In another aspect of the invention, the magnetic field is generated for a selectable interval and the signal across the generated means is a current output. The current output decays after the selectable interval has ended at a rate varying as a function of toner concentration. Preferably, the monitoring means associated with the generating means includes intelligence for processing the decaying current output to determine when the decaying current output has obtained a preselected threshold level. The monitoring means also includes intelligence and the hardware necessary to communicate software operating parameters with the printing apparatus main control system. The plurality of sensors at their respective developer units each include a coil having a linear temperature sensitive resistance used for measuring and reporting the temperature of the developer material. Preferably, temperature sensing is performed during the magnetic field generating step while a sustained uniform current is applied to a coil. Toner concentration sensing is preferably performed after such time as required for the developer material to compact responsive to the magnetic field generated by the coil. The time delay for compaction at the monitoring means is based on a software parameter from the printer main control system.

One advantage of the present invention is that the sensing apparatus is highly insensitive to various key environmental and physical constraints, such as fluctuation in both humidity and tribo-electric charge, developer aging and non-geometric packing fractions. Another advantage of the invention is the improved methods and apparatus for interfacing the plurality of individual sensor devices with the main control system of the associated electrophotographic printing apparatus using a single monitoring means adapted to communicate software operating parameters and other data with the main control system.

Yet another advantage of the present invention is that the sensing apparatus can be constructed with a minimum amount of relatively inexpensive components. Moreover, the monitoring means has a simple hierarchial design which is fully programmable and therefore adaptable on-the-fly making the system easy to manufacture and/or integrate into existing electrophotographic printing apparatus.

Still yet another advantage of the present invention is that the output from a plurality of magnetic field generating means can be discretized by use of a digital processing means at a common central micro controller. The micro controller is connected to the main processor of the electrophotographic printing apparatus via a serial command bus. Through this arrangement, the discretized signals representative of toner concentration and toner temperature from a plurality of developer stations, such as in a color printer, are developed and processed locally at the micro controller using local intelligence there. The local intelligence is adapted to function in accordance with software programmable operating parameters such as sensor excitation pulse width, sensor excitation frequency, sensor excitation level, time delay for complete compaction, and other signal processing parameters.

These and other advantages of the invention will become apparent from the following description, the description being used to illustrate preferred embodiments of the invention when read in conjunction with the accompanying drawings.

DETAILED DESCRIPTION OF THE PREFERRED EMBODIMENTS

While the present invention will hereinafter be described in connection with the preferred embodiments thereof, it will be understood that it is not intended to limit the invention to those embodiments. On the contrary, it is intended to cover all alternatives, modifications and equivalents as may be included within the spirit and scope of the invention as defined by the appended claims.

Figure 1:
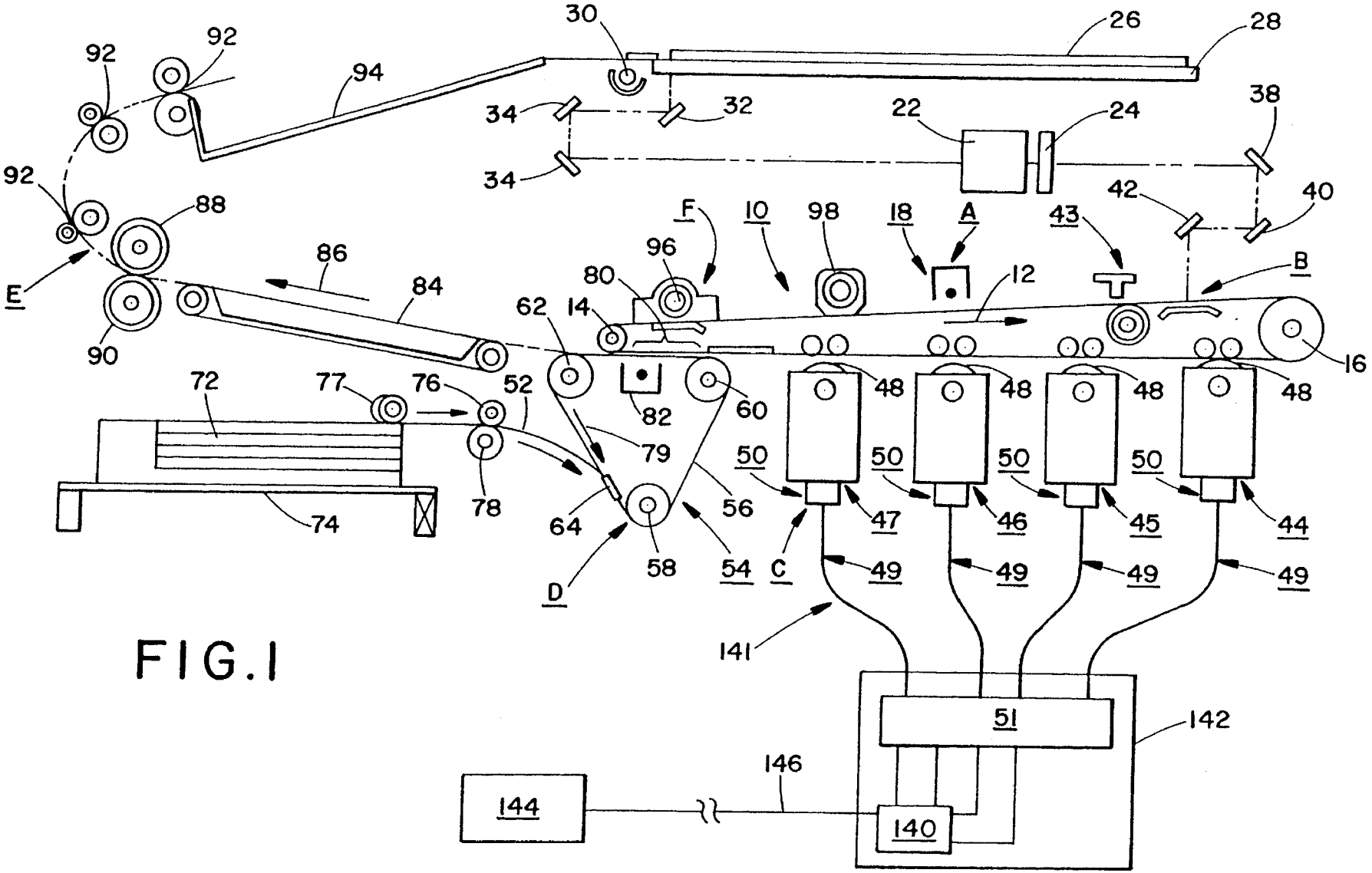
FIG. 1 is a schematic elevational view depicting an electrophotographic printing machine incorporating the toner concentration sensing apparatus of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating a toner concentration and developer temperature sensing method and apparatus of the present invention therein. It will become evident from the following discussion that the sensing apparatus of the present invention is equally well suited for use in a wide variety of electrostatographic printing and/or copying machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoreceptor, i.e. a photoconductive belt 10. Preferably, the photoconductive belt 10 is made from a photoconductive material coated on a grounding layer, which, in turn, is coated on an anti-curl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed. Belt 10 moves in the direction of arrow 12 to advance successive portions of the photoconductive surface sequentially through the various processing stations disposed about the path of movement thereof. Belt 10 is entrained about idler roller 14 and drive roller 16. Idler roller 14 is mounted rotatably so as to rotate with belt 10. Drive roller 16 is rotated by a motor coupled thereto by suitable means such as a belt drive. As roller 16 rotates, it advances belt 10 in the direction of arrow 12.

Initially, a portion of photoconductive belt 10 passes through charging station A. At charging station A, a corona generating device, indicated generally by the reference numeral 18 charges photoconductive belt 10 to a relatively high, substantially uniform potential.

Next, the charged photoconductive surface is rotated to exposure station B. Exposure station B includes a moving lens system, generally designated by the reference numeral 22, and a color filter mechanism, shown generally by the reference number 24. An original document 26 is supported stationarily upon a transparent viewing platen 28. Successive incremental areas of the original document are illuminated by means of a moving lamp assembly, shown generally by the reference numeral 30. Mirrors 32, 34 and 36 reflect the light rays through lens 22. Lens 22 is adapted to scan successive areas of illumination of platen 28. The light rays from lens 22 are transmitted through filter 24 and reflected by mirrors 38, 40 and 42 onto the charged portion of photoconductive belt 10. Lamp assembly 30, mirrors 32, 34 and 36, lens 22 and filter 24 are moved in a timed relationship with respect to the movement of photoconductive belt 10 to produce a flowing light image of the original document on photoconductive belt 10 in a non-distorted manner. During exposure, filter mechanism 24 interposes selected color filters into the optical light path of lens 22. The color filters operate on the light rays passing through the lens to record an electrostatic latent image, i.e. a latent electrostatic charge pattern, on the photoconductive belt corresponding to a specific color of the flowing light image of the original document. Exposure station B also includes a test area generator, indicated generally by the reference numeral 43, comprising a light source to project a test light image onto the charged portion of the photoconductive surface in the interimage region, i.e. the region between successive electrostatic latent images recorded on photoconductive belt 10, to record a test area. The test area, as well as the electrostatic latent image recorded on the photoconductive surface of belt 10 are developed with toner particles at a development station C.

After the electrostatic latent image and test area have been recorded on photoconductive belt 10, belt 10 advances them to the development station C. Development station C includes four individual developer units generally indicated by the reference numerals 44–47. The developer units are of a type generally referred to in the art as "magnetic brush development units." Typically, a magnetic brush development system employs a magnetizable developer material including a magnetic carrier granules having toner particles adhering triboelectrically thereto. The developer material is continually brought through a directional flux field to form a brush 48 of developer material. The developer particles are continually moving so as to provide the brush 48 consistently with fresh developer material. Development is achieved by bringing the brush 48 of developer material into contact with the photoconductive surface. Developer units 44–47, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum corresponding to the wave length of light transmitted through the filter. For example, an electrostatic latent image formed by passing the light image through a green filter will record the red and blue portions of the spectrums as areas of relatively high charge density on photoconductive belt 10, while the green rays will pass through the filter and cause the charge density on the photoconductive belt 10 to be reduced to a voltage level ineffective for development. The charged areas are then made visible by having developer unit 44 apply green absorbing (magenta) toner particles onto the electrostatic latent image recorded on a photoconductive belt 10. Similarly, a blue separation is developed by developer unit 45 with blue absorbing (yellow) toner particles, while the red separation is developed by developer unit 46 with red absorbing (cyan) toner particles. Developer unit 47 contains black toner particles and may be used to develop the electrostatic latent image formed from a black and white original document. The yellow, magenta and cyan toner particles are diffusely reflecting particles. Each of the developer units 44–47 is moved into and out of the operative position. In the operative position, the magnetic brush 48 is closely adjacent the photoconductive belt, while, in the non-operative position, the magnetic brush 48 is spaced therefrom. During development of each electrostatic latent image only one developer unit is in the operative position, the remaining developer units are in the non-operative position. This insures that each electrostatic latent image and successive test areas are developed with toner particles of the appropriate color without co-mingling. In FIG. 1, developer unit 44 is shown in the operative position with developer units 45–47 being in the non-operative position.

For each of the developers 44–47 toner concentration decreases as toner particles are applied to the photoreceptor 10. To maintain desirable levels of toner concentration in developer units 44–47, it is necessary to know when the toner concentration has fallen below a predetermined level. It is also often necessary to determine the developer temperature in the developer units 44–47 since temperature influences the concentration readings.

Accordingly, each of the developer units 44–47 is provided with a combined toner concentration and developer temperature sensing head or sensor 50 coupled on a control and signal line pair 49 to a common or shared driving/processing network 51. The processing network 51 is connected to a micro controller 140 which, in the preferred embodiment is commercially available as an 80C51FA integrated circuit device. The 80C51FA includes specialized high speed input HSI and output HSO ports and internal counters which are especially well suited for use in the preferred and alternative embodiments set forth below.

The combination of the driving/processing network 51 with the microcontroller 140 forms an integrated concentration and temperature feedback network 142. The micro controller 140 is in serial communication with a machine main processor 144 via a bus 146. The structure and operation of these components will be addressed in greater detail below.

After development, the toner image is moved to transfer station D where the toner image is transferred to a sheet of support material 52, such as plain paper for preferred example. At transfer station D, the sheet transport apparatus, indicated generally by the reference numeral 54, moves sheet 52 into contact with photoconductive belt 10. Sheet transport 54 has a pair of spaced belts 56 entrained about three rolls 58, 60 and 62. A gripper 64 extends between belts 56 and moves in unison therewith. Sheet 52 is advanced from a stack of sheets 72 disposed on tray 74. Feed roll 77 advances the uppermost sheet from stack 72 into the nip defined by forwarding rollers 76 and 78. Forwarding rollers 76 and 78 advance sheet 52 to sheet transport 54. Sheet 52 is advanced by forwarding rollers 76 and 78 in synchronism with the movement of gripper 64. In this way, the leading edge of sheet 52 arrives at a preselected position to be received by the open gripper 64. The gripper 64 then closes, securing the sheet thereto for movement therewith in a recirculating path. The leading edge of the sheet is accrued releasably by gripper 64. As the belts move in direction of arrow 79, the sheet 52 moves into contact with the photoconductive belt, in synchronism with the toner image developed thereon, at a transfer zone 80. A corona generating device 82 sprays ions onto the backside of the sheet so as to charge the sheet to the proper magnitude and polarity for attracting the toner image from photoconductive belt 10 thereto. Sheet 52 remains secured to gripper 64 so as to move in a recirculating path for three cycles. In this way, three different color toner images are transferred to sheet 52 in superimposed registration with one another. Thus, the aforementioned steps of charging, exposing, developing, and transferring are repeated a plurality of cycles to form a multi-color copy of a colored original document.

After the last transfer operation, grippers 64 open and release sheet B2. Conveyor 84 transports sheet 52 in the direction of arrow 86, to fusing station E where the transferred image is permanently fused to sheet 52. Fusing station E includes a heated fuser roll 88 and a pressure roll 90. Sheet 52 passes through the nip defined by fuser roll 88 and pressure roll 90. The toner image contacts fuser roll 88 so as to be affixed to sheet 52. Thereafter, sheet 52 is advanced by forwarding roll pairs 92 to catch tray 94 for subsequent removal therefrom by the machine operator.

The last processing station in the direction of movement of belt 10, as indicated by arrow 12, is cleaning station F. A rotatably mounted fibrous brush 96 is positioned in cleaning station F and maintained in contact with photoconductive belt 10 to remove residual toner particles remaining after the transfer operation. Thereafter, lamp 98 illuminates photoconductive belt 10 to remove any residual charge remaining thereon prior to the start of the next successive cycle.

Figure 2:
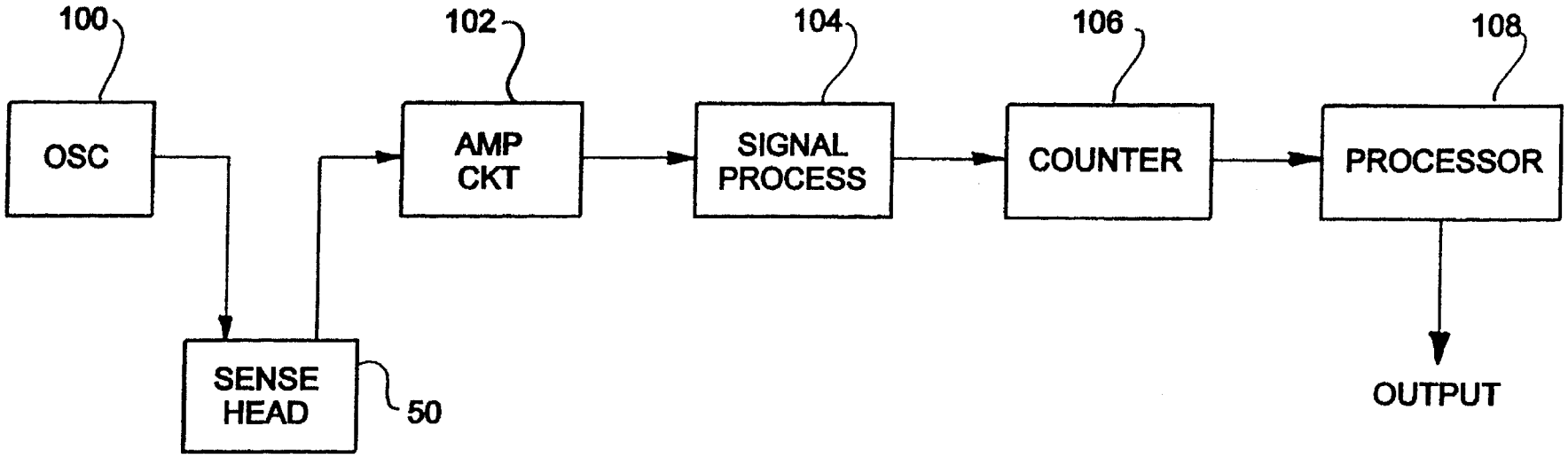
FIG. 2 (PRIOR ART)
FIG. 2 is a block diagram of a circuit used in a known sensing arrangement.

Referring to FIG. 2, a known sensing arrangement of the type manufactured by TDK under the catalog number TSO524LB-X is shown in block form. As shown in the FIGURE, each sensing head 50 is driven by an oscillator 100 which generates a 0 to 10 volt pulse width modulated analog output. The output from the sensing head 50 is amplified at an amplifying subcircuit 102. The resulting amplified signal is next processed into discrete pulses at a signal processing subcircuit 104, and those pulses are counted at a counting subcircuit 106. The counted pulses are lastly converted into a signal output, having a magnitude and frequency, by way of the processing circuit 108. The signal outputs driving from each sensing head 50 are used by the control circuitry of the associated electrophotographic printing machine.

In operation, developer mix flows adjacent the sensing head 50 while the frequency and magnitude of the signal generated thereat varies as a function of the magnetic permeability of the developer mix. As toner is depleted in the developer, the magnetic permeability increases and thereby decreases both the frequency and magnitude of the signal output. Through use of standard calibration techniques, the various frequencies or magnitudes of the signal output can, for a given operating point, be correlated into corresponding toner concentration values.

It has been found, through experimentation, that the above system provides a precise and accurate measure of toner concentration only as long as certain conditions, such as environment, developer age, tribo-electric charge, flow and packing, etc., are held constant. As any one of these conditions is altered, however, the operating point changes and the calibration of the system is shifted accordingly. For example, over a given time interval, such as during the course of a day, the tribo-electric charge of a developer mix can increase noticeably. As the tribo-electric charge increases, the operating point, and thus the calibration curve, of the sensing apparatus shifts so that the relationship of signal output magnitude to toner concentration is no longer the same. The curve is thus rendered useless. Unless the sensing apparatus is suitably adjusted to compensate for the new operating point, undesirable error in toner concentration determination is encountered. As will be appreciated by those skilled in the art, constantly manually adjusting the sensing apparatus is hardly feasible since the sensing apparatus is typically inaccessible to users other than service personnel.

A need, therefore, exists for a toner concentration and developer temperature sensing system which is substantially immune to noise and other disturbances as well as one which is on-the-fly adjustable via downloadable operating parameter values to compensate for various environmental and other changes through the use software. Also, it would be desirable to convert each of the analog signals into digital signals immediately at the sensing heads and then transmit the digitized signals through a common or shared communication bus.

One alternative to the TDK sensing arrangement discussed above, is schematically illustrated in FIG. 3 and set forth in detail in U.S. Pat. No. 5,166,729, the teachings of which are wholly incorporated herein by reference. Briefly, however, the sensing apparatus 110 of the above-identified patent includes a switched current source 112 which is controlled by a clock signal generator circuit 114 through a signal line 116. The switched current source 112, when triggered, generates a current $I_{drive}$ through the sensing head 50. The sensing head 50 includes a sensing coil 120 in series with a load resistor $R_{load}$. The preferred dimensions and other characteristics of the sensing head and coil are set forth in the earlier '729 patent. When the pulse of current $I_{drive}$ is discontinued, the current output across the load resistor $R_{load}$ begins to decay in accordance with the electromagnetic relationship set forth in the '729 patent.

A comparator 122 generates a signal on an output 124 when the current through the load resistor $R_{load}$ reaches a predetermined threshold point. The clock signal generator 114 outputs a signal on the control line 126 when the driving current $I_{drive}$ is discontinued in order that the counter and latch circuit 128 may first begin a reset which is then followed by a count up operation. The counter and latch circuit 128 performs the count up operation until the signal on the output line 124 reaches a predetermined level responsive to the threshold voltage being reached at the input of the comparator 122. The count value is outputted on the output lines 130 into a digital to analog converter (DAC) 132 for conversion of the signals on the output lines 130 into an analog output 134.

Figure 3:
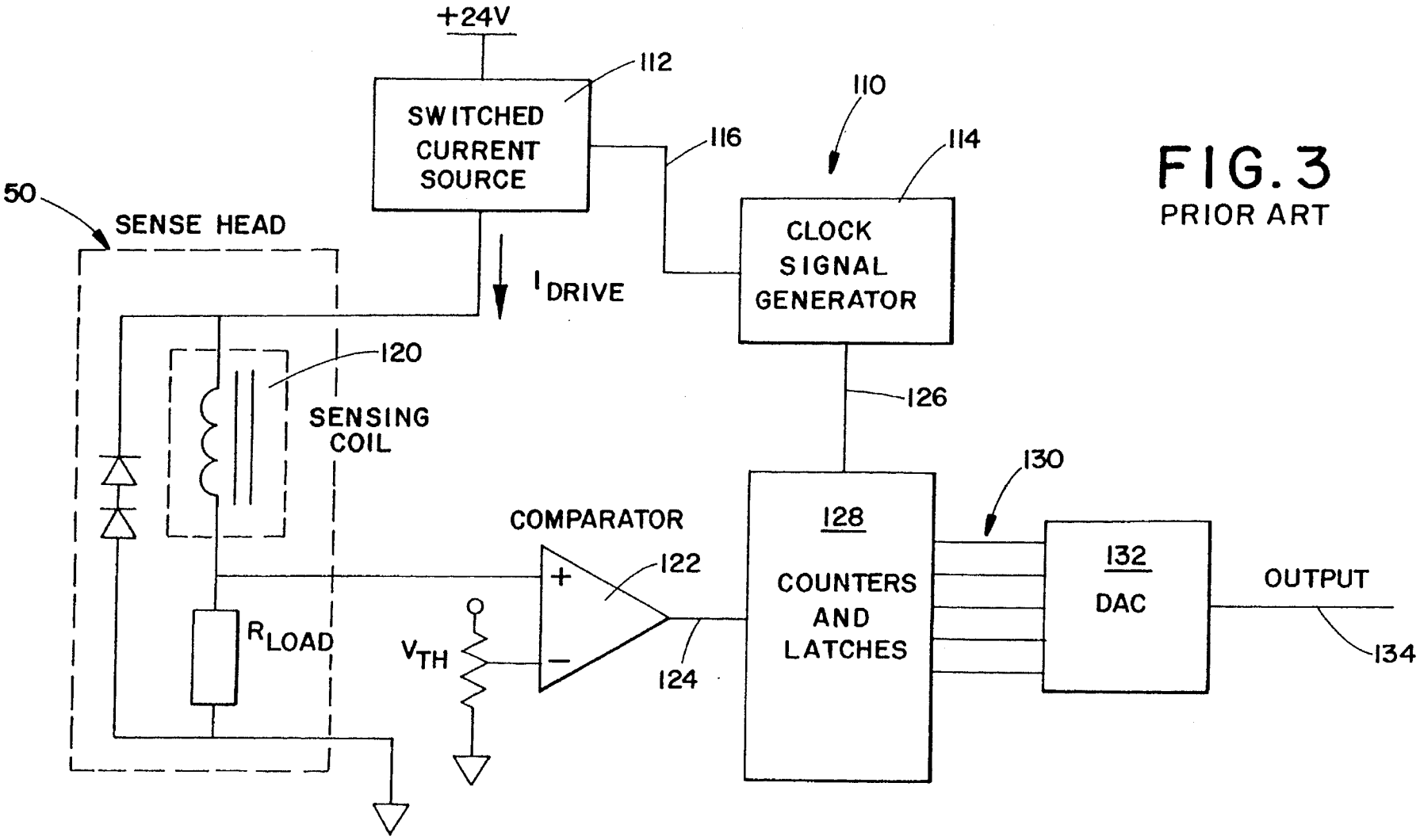
FIG. 3 PRIOR ART
FIG. 3 is a block diagram of another circuit used in another known sensing arrangement.

The sensing head 50 of this earlier patent used in combination with the components illustrated in FIG. 3 provides a fairly accurate toner concentration feedback signal. However, it would be desirable to use the same or similar sensor in combination with an intelligent controller to generate digital signals representative of both the toner concentration and developer temperature. Further, a plurality of sensing heads may preferably be connected to a single common or shared controller for multiplexed operation.

Figure 4:
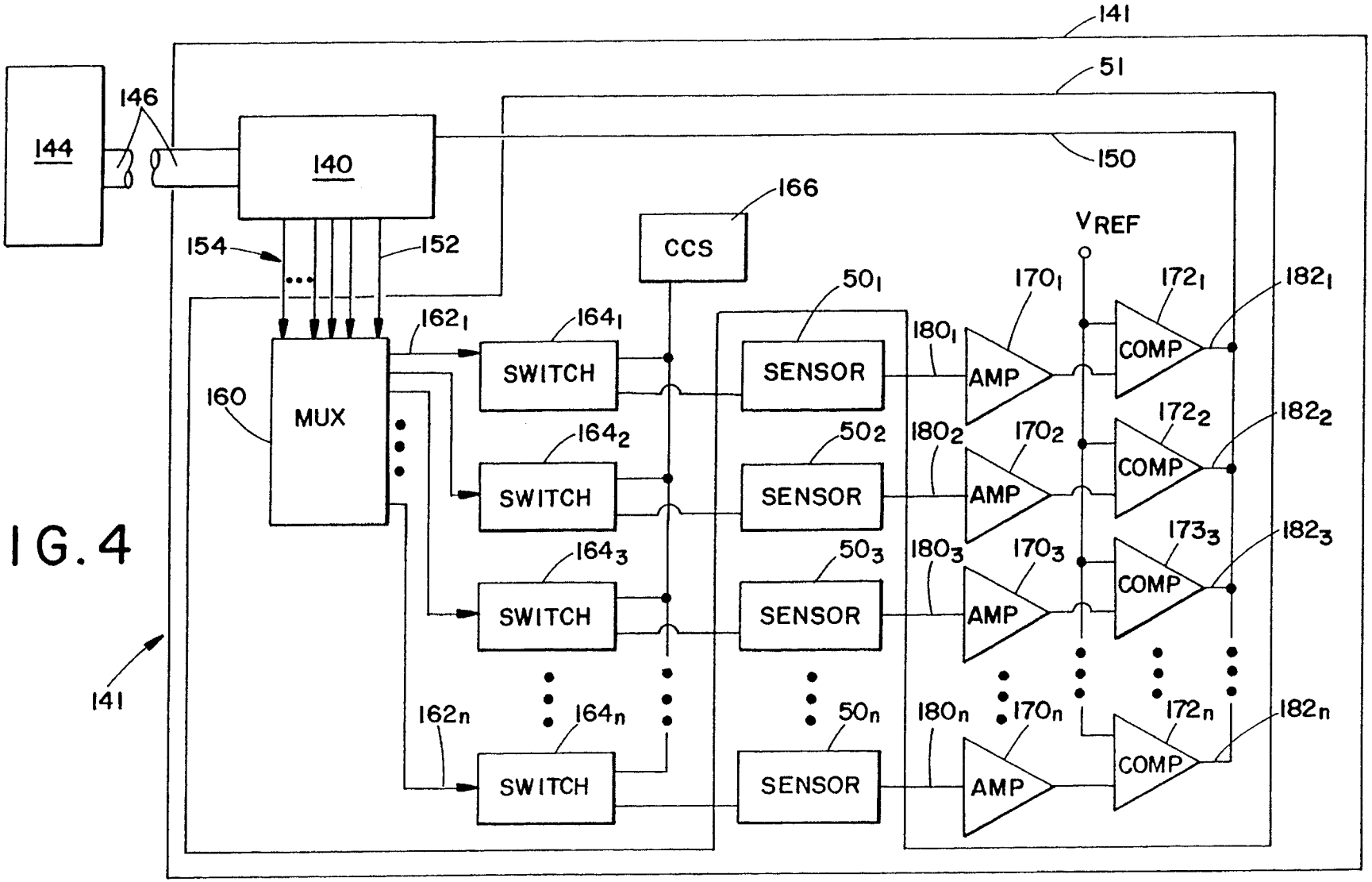
FIG. 4 is a block diagram of the preferred circuit used according to the instant invention.

With reference now to FIG. 4, the sensing apparatus 141 according to a first preferred embodiment of the instant invention is illustrated schematically. The sensing apparatus 141 includes an 80C51FA micro controller 140 in operative communication with a machine main processor 144 of the electrophotographic printing apparatus via a serial command bus 146. The micro controller 140 and the machine main processor 144 communicate using a high speed protocol. Extended systems are contemplated and made possible by connecting a plurality of micro controllers 140 along the serial command bus 146, each of the micro controllers being provided with a discrete address or node designation. In this manner, the machine main processor can communicate with motor controls, power supply controls and various sensors, indicators, or the like in the electrophotographic printing apparatus.

With continued reference to FIG. 4, the micro controller 140 is connected to the processing network 51, via a high speed input signal line 150, a high speed output signal line 152 and a plurality of address lines 154. The network 51 further includes a multiplexer 160 which is adapted to receive and decode the signals on the plurality of address lines 154 to in turn generate output signals on multiplexer select lines $\mathbf{162}_1$–$\mathbf{162}_n$. Each of the select lines $\mathbf{162}_1$–$\mathbf{162}_n$ is connected to a respective solid state switch $\mathbf{164}_1$–$\mathbf{164}_n$.

The bank of solid state switches $\mathbf{164}_1$–$\mathbf{164}_n$ are connected in parallel to a constant current source 166. The constant current source generates a single fixed current which is used by each of the respective sensor devices $\mathbf{50}_1$–$\mathbf{50}_n$ after being switched by corresponding ones of the solid state switches $\mathbf{164}_1$–$\mathbf{164}_n$.

Operationally, the multiplexer 160 receives input signals on the plurality of address lines 154, the combination which is decoded by the multiplexer to selectively activate a single one of the plurality of solid state switches $\mathbf{164}_1$–$\mathbf{164}_n$. When a one of the plurality of solid state switches is activated, a corresponding one of the sensors is thereby connected to the constant current source 166 for sensing the toner concentration and/or developer temperature in a manner described in greater detail below. Overall, however, the single selected one of the plurality of sensors $\mathbf{50}_1$–$\mathbf{50}_n$ operates substantially in a manner as that described in the '729 patent referenced above. The presence of a signal on at least one of the plurality of outputs from the multiplexer 160 causes a one of the plurality of solid state switches $\mathbf{164}_1$–$\mathbf{164}_n$ to connect a corresponding one of the sensors to the constant current source 166. At that time, a driving current $I_{drive}$ passes through a one of the sensing heads $\mathbf{50}_1$–$\mathbf{50}_n$. During this time, developer temperature is calculated based upon the driving current $I_{drive}$ and the coil resistance which is linearly dependent on the temperature of the developer.

Each of the plurality of sensing heads $\mathbf{50}_1$–$\mathbf{50}_n$ is connected to a corresponding amplifier $\mathbf{170}_1$–$\mathbf{170}_n$. The amplifiers are in turn connected to a bank of comparators $\mathbf{172}_1$–$\mathbf{172}_n$. According to the arrangement illustrated in the FIGURE, only a one of the plurality of sensing heads $50_1$–$50_n$ is active at any given time, the signal deriving therefrom being conditioned by a corresponding one of the amplifier circuits $170_1$–$170_n$ and level detected by a corresponding one of the plurality of comparators $172_1$–$172_n$. As an example, the multiplexer 160 may decode the signals present on the plurality of address lines 154 to generate a single output signal on the multiplexer output signal line $160_1$. That signal present on the signal line $160_1$ connects the first sensing head $50_1$ to the constant current source 166 through the first solid state switch $164_1$. When the signal is generated and derived from the first sensing head $50_1$, the first amplifier $170_1$ conditions the signal and passes the conditioned signal to the first comparator $172_1$. There, the condition signal is tested against a predetermined voltage level defined by a reference voltage $V_{ref}$. As illustrated in the FIGURE, the plurality of comparator circuits $172_1$–$172_n$ are "wire-OR'd" and connected to the high speed input line 150 to the microcontroller 140.

During the time within which the driving current I hd driveflows through the first sensing head $50_1$, the developer temperature is calculated based upon the driving current $I_{drive}$ and the coil resistance which is linearly dependent on the developer temperature. In the preferred embodiment, each of the sensing heads are constructed and disposed within the electrophotographic printing apparatus substantially according to the teachings of the '729 patent referenced above. The microcontroller 140 exercises complete control over the duration and amplitude of the driving current $I_{drive}$ flowing through the solid state switching circuits $164_1$–$164_n$ to the sensing heads $50_n$.

Although the preferred system illustrated in FIG. 4 includes a single constant current source 166 connected to a corresponding plurality of sensing heads and solid state switches, it is to be appreciated that alternative preferred arrangements are possible including but not limited to a plurality of current sources, one for each of the plurality of sensing heads. Each of the plurality of constant current sources would be connected directly to the outputs from the multiplexer 160. As a further alternative, the multiplexer may be dispensed with entirely if each of the plurality of constant current sources in the alternative arrangement are connected directly to a one of the plurality of address lines 154 from the microcontroller 140. In any case, the preferred embodiment illustrated in FIG. 4 is clearly advantageous in the efficient use of circuit components, reduction in power consumption, and simplicity of operation.

With reference again to the circuit of FIG. 4, after the driving current $I_{drive}$ is discontinued, a decaying signal is outputted from the formerly active sensing head on a corresponding one of the plurality of output lines $180_1$–$180_n$. The decaying signal is amplified by an amplifier $170_1$–$170_n$ and level detected in a comparator $172_1$–$172_n$. An output is generated by the comparator on the signal line $182_1$–$182_n$ when the decaying signal on the output line $180_1$–$180_n$ reaches a predetermined low threshold level. The micro controller 140 is responsive to the "wire-OR'd" signal on the line 150 to perform a calculation in order to determine the toner concentration at the sensing heads $50_1$–$50_n$. After performing this calculation, the micro controller 140 successively polls each of the sensing heads $50_1$–$50_n$ in order to determine the toner concentration levels for each of the developer units 44–47. For the system shown in FIG. 1, there are four (4) developer units, each having a sensing head, thus n=4.

The micro controller 140 includes on board RAM and ROM memories for storage of a plurality of variables and parameters used in calculating the toner concentration and developer temperature. Since the micro controller 140 is in operative serial communication with the main processor 144, these parameters and variables are downloaded to the controller when needed or beforehand to perform the various tasks at hand. Thus, sensing apparatus 141 is on-the-fly modifiable.

Figure 5A:
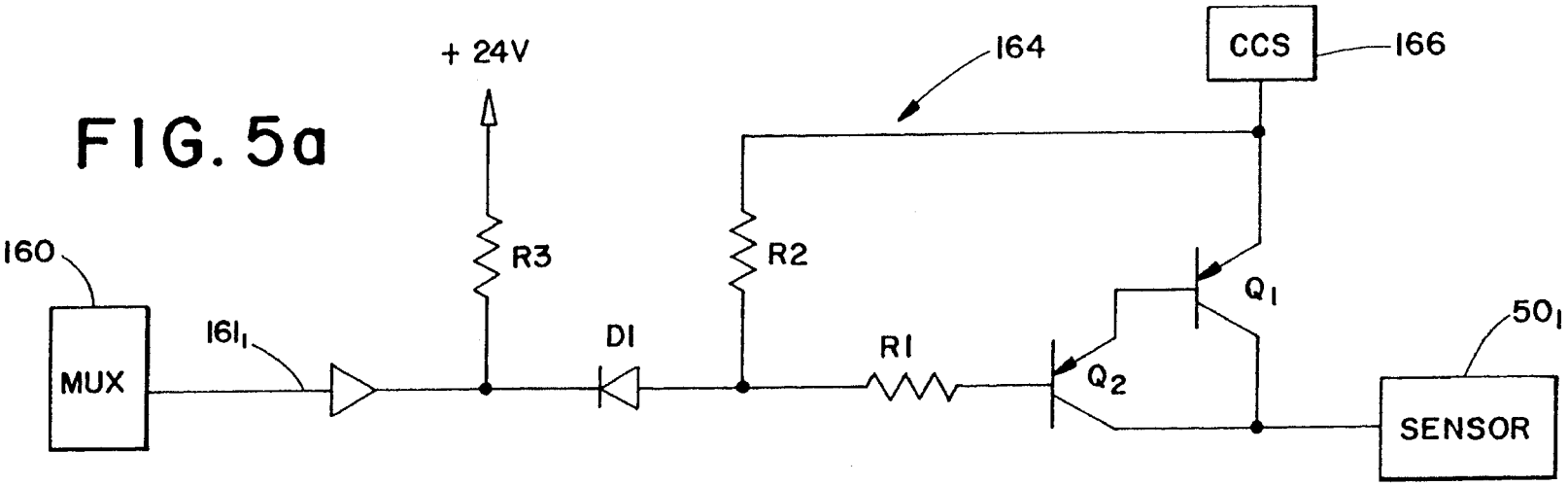
FIG. 5*a* is a schematic view of the preferred circuit embodiment used to drive the sensing head.

Referring now to FIG. 5*a*, a representative solid state switching circuit for the processing network 51 is designated by 164. The drive circuit 164, includes an arrangement of a pair of transistors Q1, Q2, a diode D1, a set of resistors R1, R2, R3 and an integrated circuit gate U2. The arrangement is adapted to transmit a current pulse of a preselected magnitude therethrough. In the preferred embodiment, the pulse is applied to the arrangement by way of conventional TTL trigger from the multiplexer 160. The diode D1, second resistor R2 and integrated circuit gate U2 are provided in the circuit to function as a level translator.

Figure 5B:
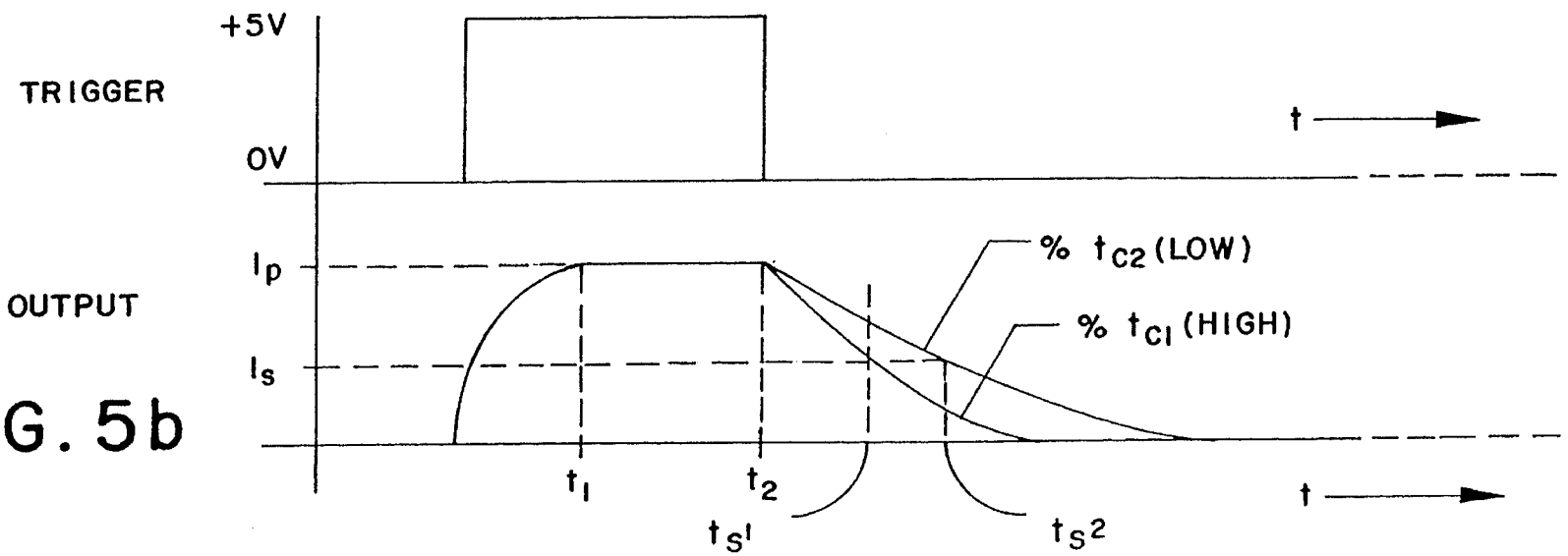
FIG. 5*b* depicts a schematic view of a pulse input for the sensing head and an output transient of the sensing head.

Referring to FIG. 5*b*, the operation of the current driving operation is described in further detail. A current pulse having a preselected magnitude and profile is imparted to the coil of the sensing head. As the pulse is applied, the output current level approaches a maximum level, namely, $I_p$. At that time $t_1$ and thereafter until $t_2$, the temperature of the developer material is measured in a manner described in greater detail below.

Assuming that the pulse has a magnitude large enough to generate a magnetic field of appropriate intensity H, a preselected volume of the developer mix which includes magnetic carrier material, is compressed. When the pulse is discontinued at $t_2$, the current output across the resistor $R_{load}$ begins to decay in accordance with the relationship:

Current Decay Rate=L/R where,

L=inductance of sensing head 50; and,

R=resistance of D1, sensor and $R_{load}$.

It should be appreciated that the inductance L is increased when placed in proximity with the magnetic carrier material. The current decay rate varies as a function of the carrier-to-toner ratio in the compressed preselected volume. That is, as toner concentration in the developer mix decreases, the relative amount of carrier material increases. Accordingly, as illustrated in FIG. 5*b*, the slope of the curve of current decay for the developer mix having a relatively low toner concentration is less steep than the curve of current decay for developer having a relatively high toner concentration.

The magnetic field generated by the sensing head varies in accordance with, among other factors, the dimensions of the sensing head such as the number of coil turns, gage of wire and core physical dimensions and material as well as the magnitude of the applied pulse. The time duration over which the pulse spans play no role since it physically requires a certain fixed amount of time to perform the physical compaction of the developer material. This time is empirically determined based on the developer/toner material being used. Different machines with differed sets of material may have different settings. This property allows for material retrofits in the field at a later date. The micro controller 140 is responsive to parameters downloaded from the main machine processor 144 via the serial command bus 146. To achieve an optimal magnetic field with the sensing head 50, the magnitude and duration of the pulse should be great enough to generate a magnetic field that adequately compresses the preselected sample over a suitable time interval without wasting excessive amounts of energy. For the exemplary sensing head 50 having the dimensions such as set forth in the earlier U.S. Pat. No. 5,166,729, it has been found that a current pulse having a magnitude of about 500 mA and a duration of about 50 msec. is adequate. In the preferred embodiment, a plurality of samplings from each sensing head 50 are obtained by the micro controller 140 and an average decay period is calculated. As an alternative, alarms or other indicia of error may be established if one or more of the results obtained from interrogating the sensing head are outside of predetermined parameters downloaded from the main machine processor 142 via the serial command bus 146.

Figure 6A:
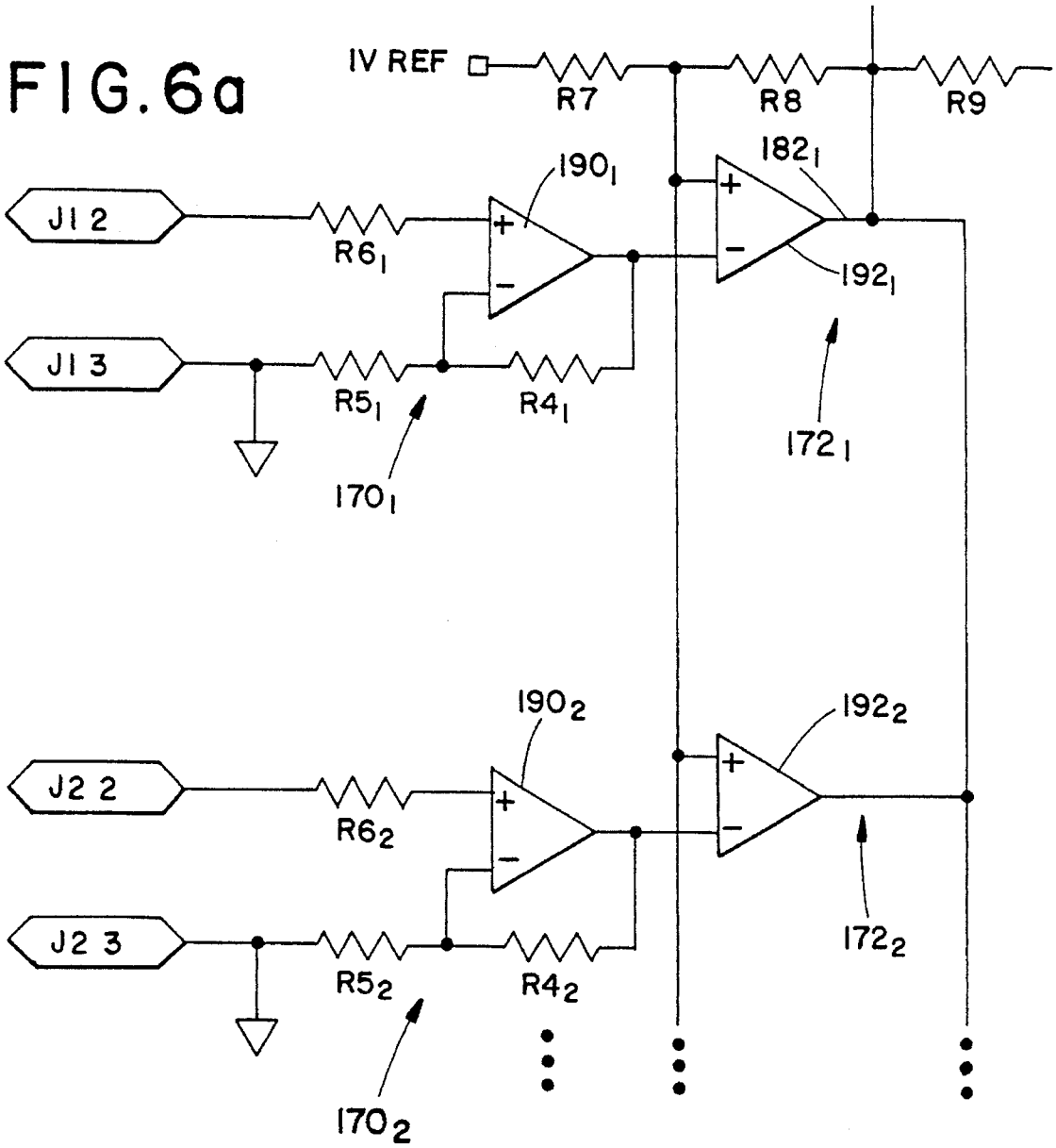
FIG. 6*a* depicts a schematic view of the preferred circuit used in conjunction with the micro controller to process the output transient of the sensing head.

Referring next to FIG. 6*a*, amplifiers $\mathbf{170}_1$–$\mathbf{170}_n$ and comparators $\mathbf{172}_1$–$\mathbf{172}_n$ of the processing network according to the first preferred embodiment are illustrated. The amplifiers $\mathbf{170}_1$–$\mathbf{170}_n$ include op amps $\mathbf{190}_1$–$\mathbf{190}_n$ which operate in an amplification mode via the resistor network provided by resistors $\mathbf{R4}_{1-n}$–$\mathbf{R6}_{1-n}$. The comparators $\mathbf{192}_1$–$\mathbf{192}_n$ are connected on the non-inverting input node to a voltage divider circuit comprising resistors R7–R9. Thus, when the level of the op amps $\mathbf{190}_1$–$\mathbf{190}_n$ reach a threshold voltage $V_{REF}$ defined by the voltage divider circuit comprising resistors R7–R9, the output of the comparators $\mathbf{192}_1$–$\mathbf{192}_n$ are in turn fed back to the micro controller 140 via the signal line $\mathbf{182}_1$ and the high speed input line 150.

Figure 6B:
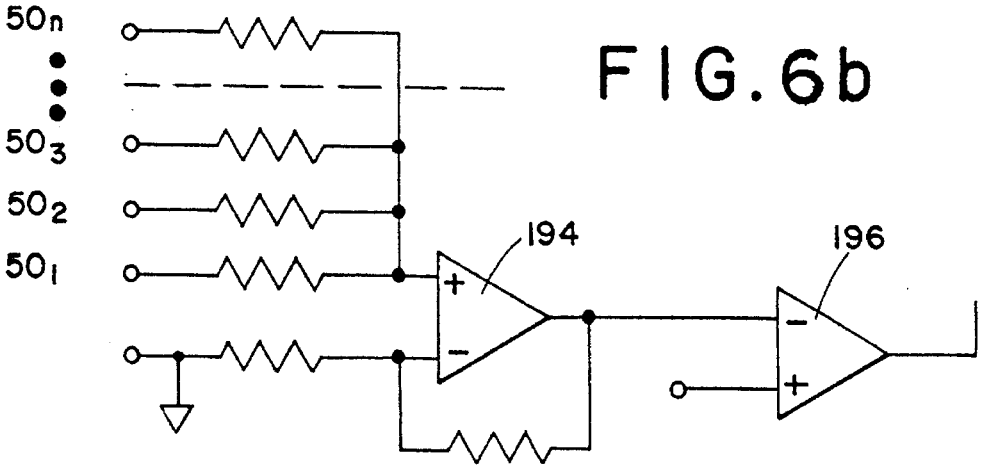
FIG. 6*b* depicts a schematic view of a second preferred circuit use in conjunction with the micro controller to process the output transient of the sensing head.

With reference next to FIG. 6*b*, the second preferred embodiment is illustrated whereby a single op amp 194 replaces the plurality of op amps $\mathbf{170}_1$–$\mathbf{170}_n$, each connected to a corresponding one of the plurality of sensing heads $\mathbf{50}_1$–$\mathbf{50}_n$. The single op amp 194 in this embodiment is directly connected to all of the sensing heads. The output is sampled when a one of the sensing heads experiences the current decay period.

Figure 7:
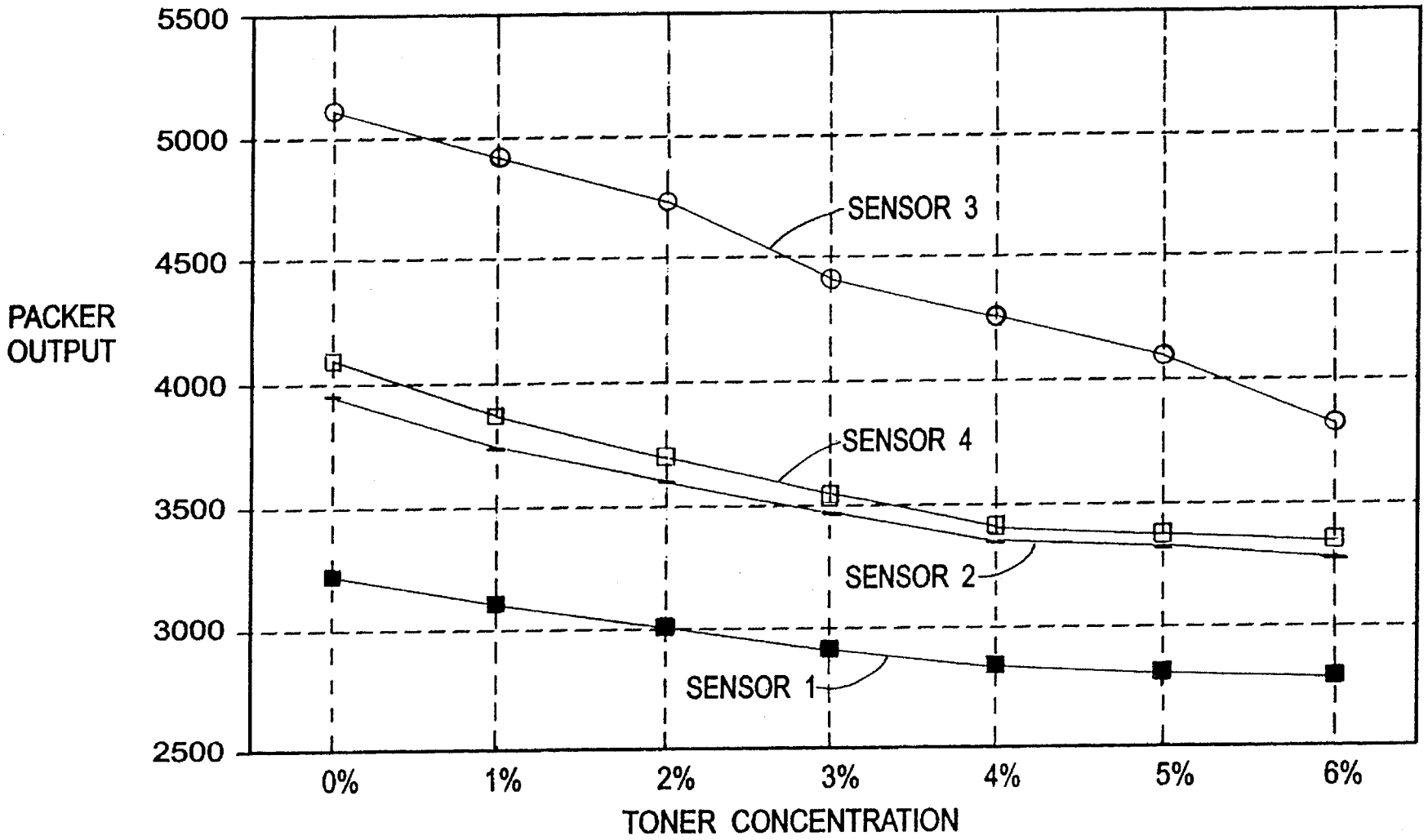
FIG. 7 is a calibration curve correlating outputs in clock count units from the microcontroller with corresponding toner concentration percentages.

With the aid of an appropriate calibration curve, such as the calibration curve in FIG. 7, the timing of the output of the comparator 172 in units of pulse counts can be matched with a corresponding toner concentration percentage. As should be recognized by those skilled in the art, the calibration curve of FIG. 7 can be constructed by successively replacing reference samples of varying toner concentration in a suitable container, applying a constant magnetic field to each sample by use of the sensing apparatus 141, and correlating a count for each sample with its respective toner concentration level or percentage.

Figure 8:
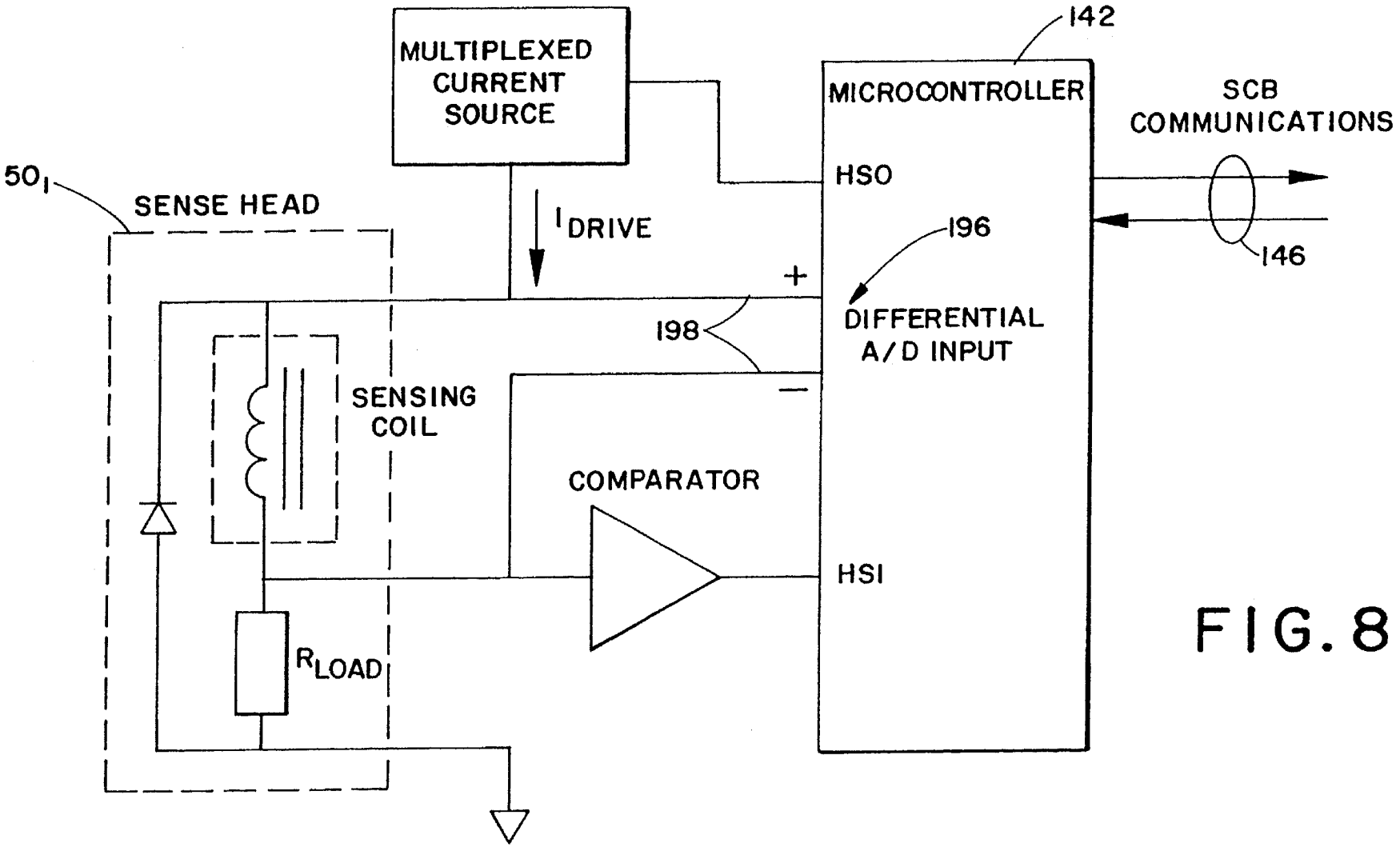
FIG. 8 is a block diagram of an alternative preferred circuit used in the sensing apparatus of the present invention.

With reference next to FIG. 8, an alternative preferred embodiment of the present invention is provided for temperature sensing using the toner concentration sensor directly. Since the characteristics of developer mixtures used in xerographic engines change dramatically with variations in temperature and humidity, developer temperature sensing is very useful. Large variations in image density due to temperature and humidity fluctuations requires a compensation within the xerographic equipment, such as a modification to the toner concentration, charge voltage, developer bias, etc.

Prior systems have measured temperature of the developer mixture only indirectly by inferring the developer temperature from measurements taken at various locations within the developer housing. The various temperature readings and temperature sensor placement are developed empirically.

Since the sensing head $\mathbf{50}_1$ described above utilizes a sensing coil constructed from copper wire, it is possible to use the same sensor multiplexedly in both a toner concentration and temperature sensing mode of operation. The sensing coil has a nominal resistance of 3 ohms at room temperature in the preferred embodiment. The resistance versus temperature coefficient for copper is approximately 0.004 ohms per ohms degree centigrade. Therefore, the change in the coil resistance is about 0.01 ohm per degree centigrade. For a typical 500 milliamp excitation current, a 6 millivolt per degree celsius change in voltage across the sensing coil is observed.

This voltage change is observable during the excitation pulse of the sensing head $\mathbf{50}_1$ using an analog to digital input 196 on the micro controller 142. The micro controller 142 outputs a pulse current as described above and merely observes the differential voltage occurring on the signal lines 198 connected to the differential analog to digital input 196. Suitable mathematical calculations are performed within the micro controller 142 to determine the temperature of the toner at the sensing head $\mathbf{50}_1$. This determined value is communicated to the main processor (not shown) via the serial command bus 146.

Figure 9:
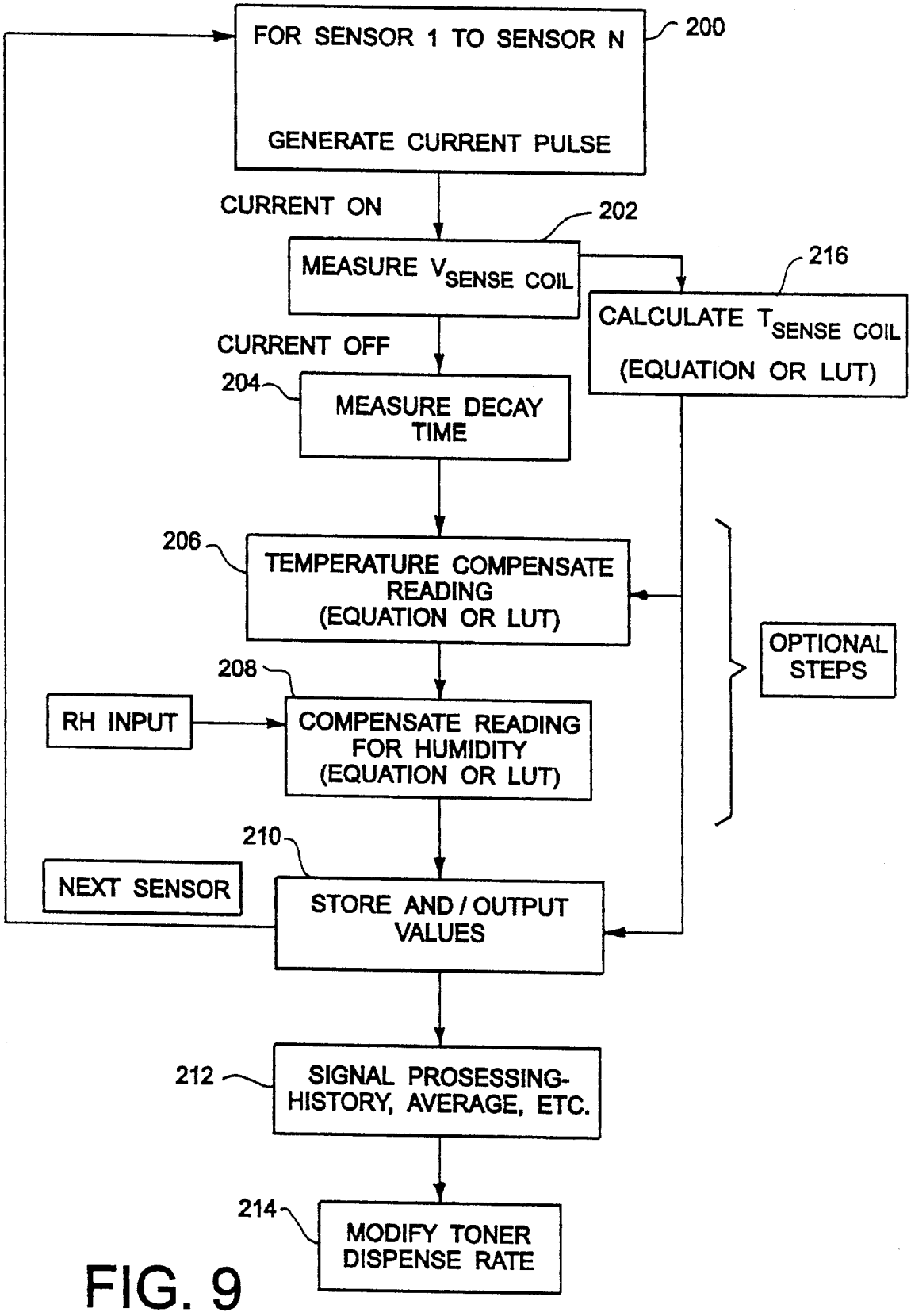
FIG. 9 is a flow chart illustrating an operational and control method according to the present invention; and, FIG. 10 is a calibration curve correlating sensor output signals in digital bit units with developer temperature values.

With reference next to FIG. 9, a method of operating the preferred embodiment will be described. For each of the sensors 1 to n, a current pulse $I_{drive}$ is generated at step 200 and the voltage developed across the sensing head coil is measured during the pulse at step 202. The decay time is measured at step 204.

While the sensor excitation current is present, the voltage across the sensing coil is measured in step 202 using the differential analog to digital input 196 of the micro controller 142 (FIG. 8). In step 216, the developer temperature is calculated using an equation or a look up table stored in the RAM or ROM of the micro controller 142.

Figure 10:
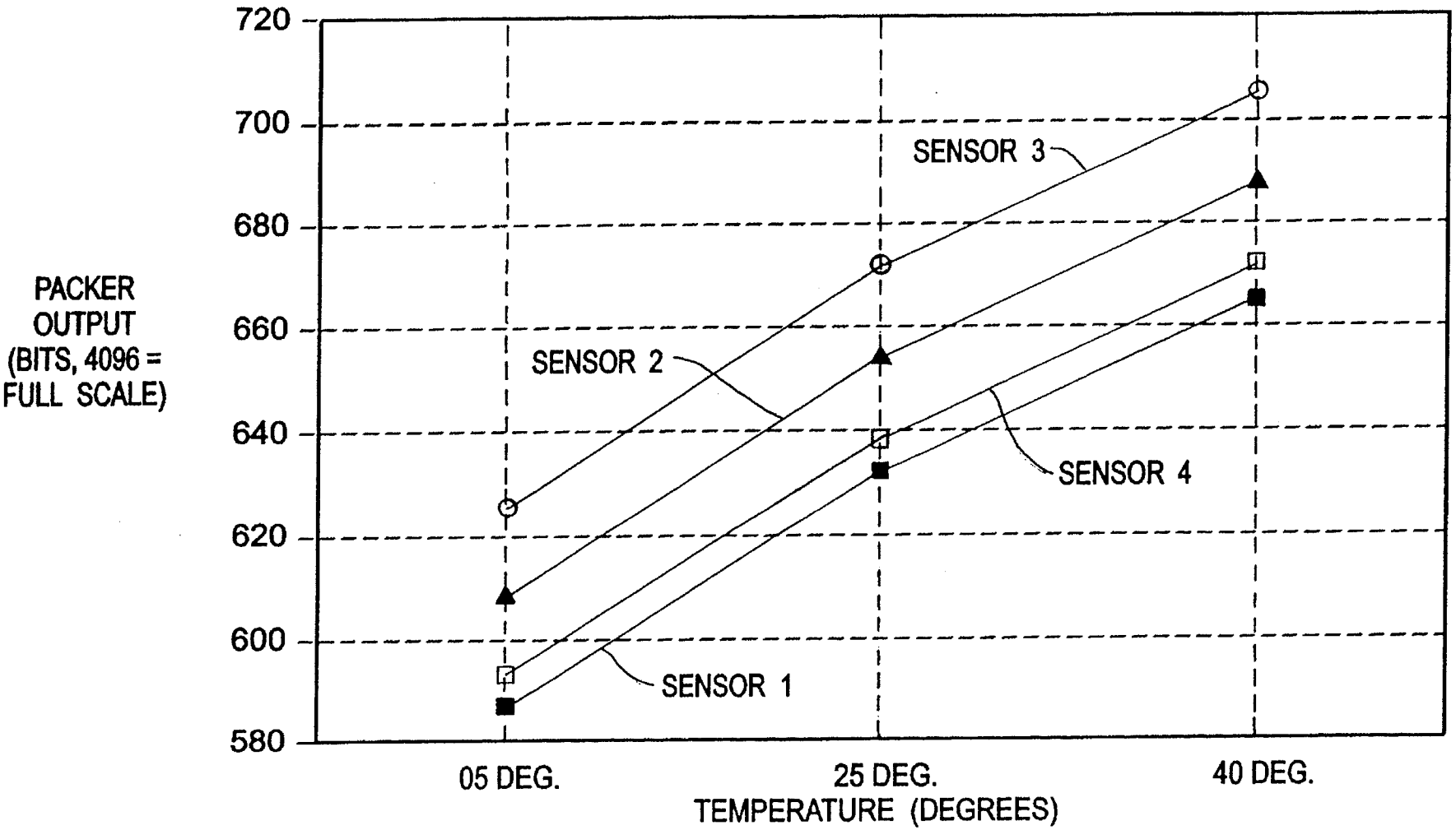

The look up table pairs output signals from the sensing heads with corresponding temperature values such as represented in FIG. 10 where a set of output vs. temperature curves are shown for four (4) sensing heads. Since the curves are substantially linear, interpolation techniques are used for output readings which fall between empirical calibration points.

If an ambient temperature reading is available, the micro controller 142 compensates the decay time value to adjust for variations in the temperature in step 206 using a mathematical equation or a look up table storing values. At step 208, if a humidity input is available, the micro controller 142 compensates the decay reading once again to adjust for variations in the humidity using an equation or a look up table. The temperature and humidity compensation are optional steps. In the preferred embodiment, the micro controller reacts to a parameter stored in RAM to determine whether to perform operational compensations.

Next, at step 210, the micro controller either stores the calculated value or outputs the value to the machine main processor 144 via the serial command bus 146. At step 212, the micro controller 142 performs the necessary signal processing on the decay time calculated above in order to determine the toner concentration level. Also, the micro controller performs a number or other calculations including the generation of a historical log of past concentration values as well as an averaging of the most recent values.

Lastly, at step 214, the micro controller outputs a signal to the machine main processor 144 via the serial command bus 146 to modify the toner dispense rate at the appropriate developer unit 44–47 in order to maintain a predefined toner concentration level.

The invention has been described with reference to the preferred embodiments. Obviously, modifications and alterations will occur to others upon a reading and understanding of this specification. It is intended to include all such modifications and alterations insofar as they come within the scope of the appended claims or the equivalence thereof.

Having thus described the invention, we now claim:

1. A method of sensing toner concentration in a developer container adapted to retain developer material, the developer material including varying concentrations of magnetic carrier material and toner material, the method comprising the steps of:

providing a micro controller for storing a first set of parameters;

providing a sensing head in the developer container for generating a magnetic field exclusively in response to a presence of a first signal whereby a minor portion of the developer material is compressed due to the magnetic field;

applying said first signal to said sensing head from said micro controller for a first variable programmable time period;

after said variable programmable time period, discontinuing said first signal and observing by the micro controller a second signal from the sensing head which decays as a function of the concentration of the toner material; and, monitoring the second signal to determine the concentration of the toner material based on said first set of parameters stored in said micro controller.

2. The method of sensing toner concentration according to claim 1 further comprising the step of successively applying and discontinuing the first signal and observing by the micro controller a successive plurality of second signals from the sensing head which decay as a function of the concentration of the toner material; and, determining the concentration of the toner material based on an average of the observed plurality of successive second signals.

3. The method of sensing toner concentration according to claim 1 further comprising the steps of:

providing a plurality of sensing heads, each for generating a magnetic field exclusively in response to a presence of a respective first signal from a plurality of first signals wherein minor portions of developer material are respectively compressed due to each respective magnetic field generated;

successively applying said plurality of first signals respectively to said plurality of sensing heads from said micro controller for a plurality of first respective variable programmable time periods;

after each of the plurality of first respective variable programmable time periods, discontinuing said plurality of first signals and observing by the micro controller a plurality of second signals from the sensing heads which decay as a function of the respective concentrations of toner material compressed due to said each respective magnetic field generated; and, monitoring each of the plurality of second signals to determine the respective concentrations of the toner material based on a second set of parameters stored in said micro controller.

4. The method of sensing toner concentration according to claim 3 further comprising the steps of:

successively applying and discontinuing the first signal and observing by the micro controller a successive plurality of said second signals from the sensing heads which decay as a function of the concentration of the toner material; and, determining the concentration of the toner material based on an average of the observed plurality of successive second signals.

5. The method of sensing toner concentration according to claim 1 further comprising the step of downloading said first set of parameters into said micro controller from an operatively associated external machine main processor device.

6. The method of sensing toner concentration according to claim 5 further comprising the step of updating at least one of the parameters stored in said micro controller by downloading said at least one parameter into the micro controller from an operatively associated external main machine processor device.

7. The method of sensing toner concentration according to claim 1 wherein the step of determining the concentration of toner material includes the steps of:

reading said first set of parameters from an internal memory of the micro controller; and, calculating the concentration of toner based on said first set of parameters read from the internal memory and according to a predetermined algorithm stored within the micro controller.

8. The method of sensing toner concentration according to claim 7 further comprising the steps of:

providing a plurality of sensing heads each for generating a magnetic field in response exclusively to a presence of a respective first signal; and, applying a first signal to selected ones of said plurality of sensing heads from said micro controller based on parameters stored within the internal memory of said micro controller.

9. The method of sensing toner concentration according to claim 8 further comprising the steps of:

successively applying and discontinuing the first signal and observing by the micro controller a successive plurality of second signals from the sensing heads which decay as a function of the concentration of the toner material; and, determining the concentration of the toner material based on an average of the observed plurality of successive second signals.

10. The method of sensing toner concentration according to claim 1 wherein said first set of parameters stored in said micro controller are selectively used to adjust the determination of the concentration of the toner material.

11. A method of sensing developer temperature in a developer container adapted to retain developer material, the developer material including magnetic carrier material and toner material, the method comprising the steps of:

providing a sensing head in the developer container for generating a magnetic field in response to a presence of a first signal wherein a minor portion of the developer material is compressed due to the magnetic field;

applying said first signal to said sensing head from a micro controller for a first variable programmable time period;

during said variable programmable time period, observing in the micro controller a second signal from the sensing head which is a function of the first signal and the temperature of the developer material; and, monitoring the second signal to determine the temperature of the developer material based on parameters stored in said micro controller.

12. The method of sensing developer temperature according to claim 11 further comprising the step of successively applying and discontinuing the first signal and observing in the micro controller a successive plurality of second signals from the sensing head; and, determining the temperature of the developer material based on an average of the observed plurality of successive second signals.

13. The method of sensing developer temperature according to claim 11 further comprising the steps of:

providing a plurality of sensing heads each for generating a magnetic field in response exclusively to a presence of a respective first signal;

successively applying each respective first signal to said plurality of sensing heads from said micro controller for a first plurality of respective variable programmable time periods;

during each of the first plurality of respective variable programmable time periods, observing in the micro controller a plurality of second signals from the sensing heads which is a function of the respective temperatures of the developer material; and, monitoring each of the plurality of second signals to determine the respective temperatures of the developer material based on a second set of parameters stored in said micro controller.

14. The method of sensing developer temperature according to claim 12 further comprising the step of successively applying the first signal and observing in the micro controller a successive plurality of second signals from the sensing heads; and, determining the temperature of the developer material based on an average of the observed plurality of successive second signals.

15. The method of sensing developer temperature according to claim 11 further comprising the step of downloading said parameters into said micro controller from an operatively associated external machine main processor device.

16. The method of sensing developer temperature according to claim 15 further comprising the step of updating at least one of the parameters stored in said micro controller by downloading said at least one parameter into the micro controller from an operatively associated external main machine processor device.

17. The method of sensing developer temperature according to claim 11 wherein the step of determining the temperature of developer material includes the steps of reading said parameters from an internal memory of the micro controller; and, calculating the temperature of toner based on said parameters read from the internal memory and according to a predetermined algorithm stored within the micro controller.

18. The method of sensing developer temperature according to claim 17 further comprising the steps of:

providing a plurality of sensing heads each for generating a magnetic field in response exclusively to a presence of a respective first signal; and, applying a first signal to selected ones of said plurality of sensing heads from said micro controller based on parameters stored within the internal memory of said micro controller.

19. The method of sensing developer temperature according to claim 18 further comprising the steps of:

successively applying the first signal and observing in the micro controller a successive plurality of second signals from the sensing heads; and, determining the temperature of the developer material based on an average of the observed plurality of successive second signals.

20. The method of sensing developer temperature according to claim 11 wherein said parameters stored in said micro controller are selectively used to adjust the determination of the temperature of the developer material.

21. In a printing apparatus of the type having means for developing a latent image disposed on a retentive member, the developing means including a developer container adapted to retain a quantity of developer material, the developer material having a varying concentration of magnetic carrier material and toner material, a programmable toner concentration sensing apparatus comprising:

means for generating a magnetic field within the developer container; and, micro controller including a:

means for controlling said generating means to generate the magnetic field for a programmable interval within the developer container based on parameters stored within the micro controller, wherein a preselected portion of the developer material is compressed by the magnetic field and a signal is generated across said generating means, the signal across said generating means decaying after the programmable interval as a function of the concentration of the toner material; and means, responsive to the controlling means, for monitoring the decay in the signal across the generating means to determine the concentration of the toner material based on parameters stored in the micro controller.

* * * * *